US010483036B2

(12) United States Patent
Salvatti

(10) Patent No.: US 10,483,036 B2
(45) Date of Patent: Nov. 19, 2019

(54) VOICE COIL HAVING EPOXY-BOUND WINDING LAYERS

(71) Applicant: Apple Inc., Cupertino, CA (US)

(72) Inventor: Alexander V. Salvatti, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/260,112

(22) Filed: Sep. 8, 2016

(65) Prior Publication Data

US 2017/0223463 A1 Aug. 3, 2017

Related U.S. Application Data

(60) Provisional application No. 62/289,104, filed on Jan. 29, 2016.

(51) Int. Cl.

| | |
|---|---|
| ***H01F 41/12*** | (2006.01) |
| ***H01F 5/06*** | (2006.01) |
| ***H01F 41/066*** | (2016.01) |
| ***F02D 41/00*** | (2006.01) |
| ***H01F 7/06*** | (2006.01) |
| ***H01F 7/18*** | (2006.01) |
| ***H04R 9/04*** | (2006.01) |
| ***H04R 31/00*** | (2006.01) |
| *H04R 9/06* | (2006.01) |

(52) U.S. Cl.

CPC ..... *H01F 41/12* (2013.01); *F02D 41/00* (2013.01); *H01F 5/06* (2013.01); *H01F 7/064* (2013.01); *H01F 7/1844* (2013.01); *H01F 41/066* (2016.01); *H04R 9/045* (2013.01); *H04R 31/00* (2013.01); *H04R 9/06* (2013.01); *H04R 2499/11* (2013.01)

(58) Field of Classification Search

CPC ..... H01F 41/12; H01F 41/066; H01F 5/06; H01F 7/064; H01F 7/1844; H04R 9/045; H04R 31/00; H04R 9/06; H04R 2499/11

See application file for complete search history.

(56) References Cited

U.S. PATENT DOCUMENTS

| | | | | |
|---|---|---|---|---|
| 4,225,756 | A * | 9/1980 | Babb | H04R 7/20 29/605 |
| 6,555,601 | B1 | 4/2003 | Behm et al. | |
| 7,598,837 | B2 | 10/2009 | Gilmartin et al. | |
| 8,144,918 | B2 | 3/2012 | Ikeda et al. | |

(Continued)

FOREIGN PATENT DOCUMENTS

| | | |
|---|---|---|
| JP | 2007005845 A | 1/2007 |
| WO | WO 2009/117136 A2 | 9/2009 |

*Primary Examiner* — Tuan D Nguyen

(74) *Attorney, Agent, or Firm* — Womble Bond Dickinson (US) LLP

(57) ABSTRACT

An audio speaker including a bobbin-less voice coil having epoxy-bound winding layers is disclosed. More particularly, a voice coil may include a first winding layer and a second winding layer coaxially arranged about a central axis. The winding layers may include respective wire turns coiled about the central axis in a longitudinal direction. The winding layers may be bound by an epoxy matrix. For example, the epoxy matrix may be disposed radially between the first winding layer and the second winding layer to bond first wire turns to second wire turns, and to bond the winding layers to a speaker diaphragm.

19 Claims, 11 Drawing Sheets

(56) References Cited

U.S. PATENT DOCUMENTS

| | | | | |
|---|---|---|---|---|
| 2001/0033673 | A1* | 10/2001 | Babb | H04R 9/04 381/401 |
| 2004/0136559 | A1* | 7/2004 | Suzuki | H01F 7/066 381/400 |
| 2011/0109419 | A1* | 5/2011 | Cooper | H01F 5/06 336/206 |
| 2013/0200978 | A1 | 5/2013 | Wedley | |
| 2013/0266173 | A1* | 10/2013 | Niedermann | H04R 9/02 381/400 |

* cited by examiner

VOICE COIL HAVING EPOXY-BOUND WINDING LAYERS

This application claims the benefit of priority from U.S. Provisional Application No. 62/289,104, filed on Jan. 29, 2016, which is incorporated herein by reference.

BACKGROUND

Field

Embodiments of the invention are in the field of audio speakers and, in particular, audio speakers including voice coils having epoxy-bound winding layers.

Background Information

Micro speaker voice coils commonly include four layers of voice coils windings to provide dimensional stability. When fewer layers of voice coil windings, e.g., two layers, is desired, the voice coil is typically wound on a bobbin, which is also known as a former. The bobbin may be a thin strip of material such as paper, meta-aramid, or polyamide. The bobbin may be attached to a diaphragm of the micro speaker, and the bobbin may bridge a distance between the voice coil windings and the diaphragm. The voice coil windings on the bobbin may be suspended in a magnetic gap of a magnet assembly of the micro speaker.

SUMMARY

Existing two-layer micro speaker voice coils that are supported by a bobbin have an intrinsic negative cost impact deriving from the cost of the bobbin. Although a bobbin-less two-layer coil can be used in some limited applications, higher power and/or wider bandwidth transducers place enough stress on the voice coil that the bobbin-less two-layer coil lacks a required physical robustness. Furthermore, existing four-layer micro speaker voice coils may have coil windings that include a portion not within the magnetic gap, e.g., in an area above the magnetic gap and below a diaphragm of the micro speaker. This portion of the coil windings outside of the magnetic gap may have a winding mass that causes a parasitic mass penalty. Thus, existing solutions for micro speaker voice coil configurations tend to force a trade-off between system cost and system efficacy.

In an embodiment, a voice coil includes a first winding layer, a second winding layer, and an epoxy matrix between the winding layers. The first winding layer and the second winding layer may have respective wire turns around a central axis, and the wire turns of the second winding layer may be coaxial with the wire turns of the first winding layer about the central axis. For example, the first winding layer may be radially offset from the second winding layer. Thus, the epoxy matrix may bond the first wire turns concentrically with the second wire turns. In an embodiment, the first wire turns are longitudinally disposed along the central axis between a first bottom turn and a first top turn, and the second wire turns are longitudinally disposed along the central axis between a second bottom turn and a second top turn. The epoxy matrix may include an epoxy spacer longitudinally over one or more of the first top turn or the second top turn. In an embodiment, the first top turn is longitudinally offset from the second top turn. In an embodiment, the epoxy spacer is radially offset from the first winding layer and is longitudinally over the second top turn.

In an embodiment, an electromagnetic transducer for sound generation includes a diaphragm configured to move along the central axis, and the voice coil is coupled to the diaphragm. The epoxy matrix may be radially between the first winding layer and the second winding layer to bond the first wire turns to the second wire turns. In an embodiment, the epoxy matrix bonds the first top turn to the diaphragm.

In an embodiment, the wire turns of the voice coil include a wire having a conductive core surrounded by an insulating jacket. The epoxy matrix may contact the insulating jacket of the wire of the first wire turns and the second wire turns. In an embodiment, the wire turns include respective turn diameters about the central axis, and the turn diameters are less than 25 millimeters.

In an embodiment, a method of forming a voicecoil includes winding a wire around a central axis to form a winding layer having several wire turns longitudinally disposed along the central axis between a bottom turn and a top turn. The method includes placing an epoxy resin longitudinally over the top turn. The method includes curing the epoxy resin to form an epoxy spacer longitudinally over the top turn. The method includes mounting the epoxy spacer on a diaphragm of an electromagnetic transducer. In an embodiment, winding the wire includes winding the wire around a sleeve coaxially aligned with the central axis. The method may further include removing the sleeve from the winding layer. Placing the epoxy resin may include filling a gap with the epoxy resin. For example, the gap may be radially offset from the sleeve and may be longitudinally between the diaphragm and the top turn. In an embodiment, curing the epoxy resin forms an epoxy matrix, and the epoxy matrix bonds the top turn to the diaphragm. Curing the epoxy resin may include delivering an electrical current through the wire to heat-cure the epoxy resin.

DETAILED DESCRIPTION

Figure 1:
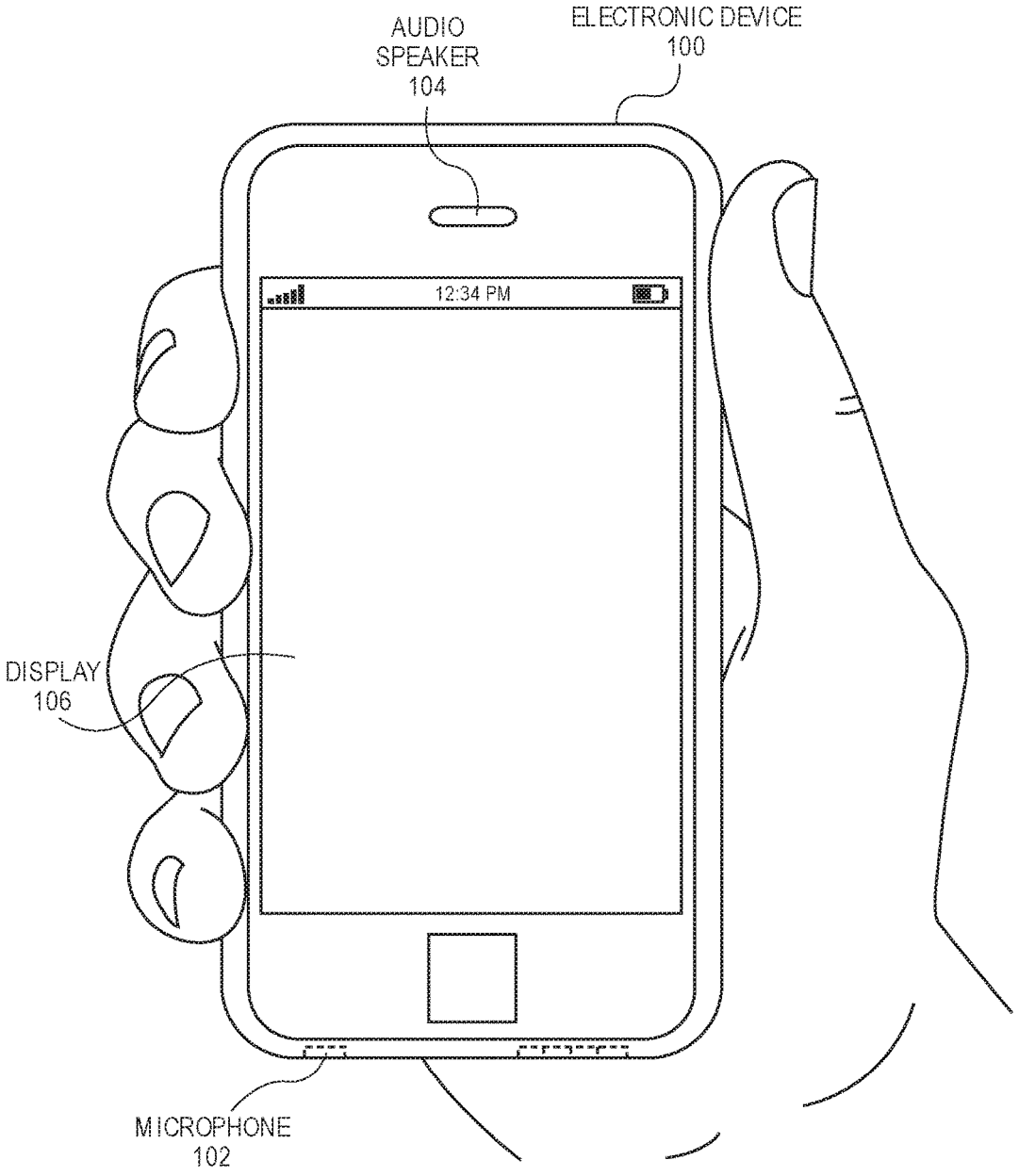
FIG. 1 is a pictorial view of an electronic device in accordance with an embodiment.

Embodiments describe an audio speaker having a bobbin-less voice coil incorporating epoxy-bound winding layers.

While some embodiments are described with specific regard to integration within mobile electronics devices, such as handheld devices, the embodiments are not so limited and certain embodiments may also be applicable to other uses. For example, an audio speaker as described below may be incorporated into other devices and apparatuses, including desktop computers, laptop computers, or motor vehicles, to name only a few possible applications.

In various embodiments, description is made with reference to the figures. Certain embodiments, however, may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "top" may indicate a location in a first direction toward a reference point, e.g., a speaker diaphragm. Similarly, "bottom" may indicate a location in a second direction away from the reference point. Such terms, however, are provided to establish relative frames of reference, and are not intended to limit the use or orientation of an audio speaker (or components of the audio speaker) to a specific configuration described in the various embodiments below.

In an aspect, an audio speaker includes a bobbin-less voice coil having one or more winding layers bound within a structural adhesive matrix. The structural adhesive matrix may be made from any suitable material such as a paste or liquid which hardens once cured. The structural adhesive matrix may be applied to windings of the voice coil either during or after the process of winding the voice coil. Thus, the structural adhesive matrix may provide structural support to the windings, e.g., by encapsulating the windings. Some suitable candidates for the structural adhesive include materials from several chemistries, e.g., the acrylic or epoxy families of adhesives. Such materials are hereafter referred to as epoxy for the sake of simplicity. The epoxy matrix may include an epoxy spacer, e.g., a structural adhesive filling an area between a winding layer and a diaphragm of the audio speaker. The epoxy matrix may provide structural support to the voice coil windings. Thus, the audio speaker does not require a former to suspend the voice coil within a magnetic gap. By eliminating the former, an overall cost of the audio speaker may be reduced. Furthermore, the lack of a bobbin/former saves radial space within the magnetic gap that would otherwise be occupied by the bobbin, and thus, the magnetic gap may be narrowed. A narrower magnetic gap may result in a higher motor efficiency of the audio speaker. For example, modeling suggests that eliminating the former and/or the voice coil windings outside of the magnetic gap may result in an improvement in acoustic midband efficiency performance of 2-3 dB as compared to a typical micro speaker design.

Referring to FIG. 1, a pictorial view of an electronic device is shown in accordance with an embodiment. An electronic device 100 may be a smartphone device. Alternatively, it could be any other portable or stationary device or apparatus, such as a laptop computer or a tablet computer. The electronic device 100 may include various capabilities to allow the user to access features involving, for example, calls, voicemail, music, e-mail, internet browsing, scheduling, and photos. The electronic device 100 may also include hardware to facilitate such capabilities. For example, an integrated microphone 102 may pick up the voice of a user during a call, and an audio speaker 104, e.g., a micro speaker, may deliver a far-end voice to the near-end user during the call. The audio speaker 104 may also emit sounds associated with music files played by a music player application running on the electronic device 100. A display 106 may present the user with a graphical user interface to allow the user to interact with the electronic device 100 and/or applications running on the electronic device 100. Other conventional features are not shown but may of course be included in the electronic device 100.

Figure 2:
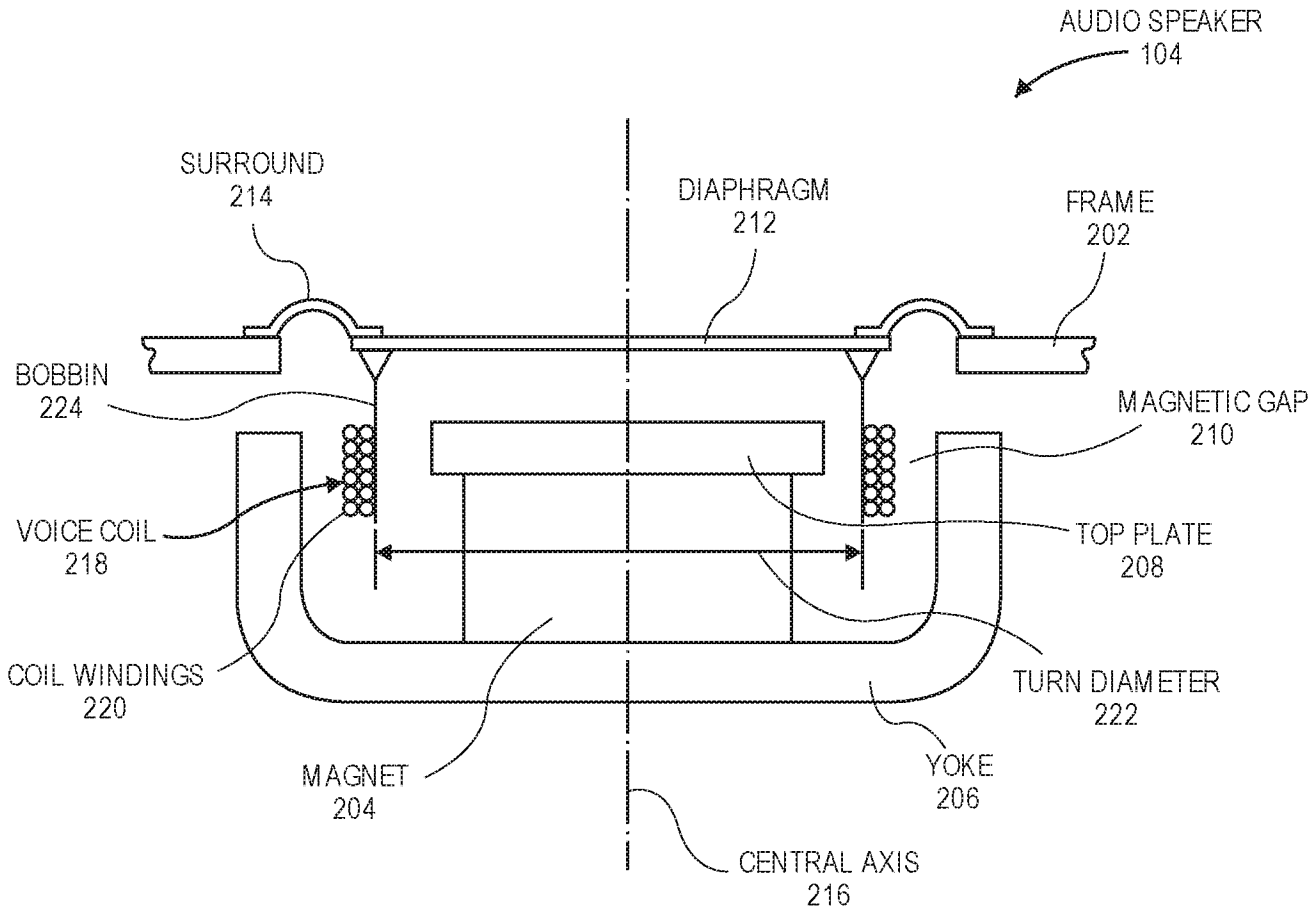
FIG. 2 is a sectional view of an audio speaker including a voice coil that uses a former to support a two-layer voice coil

Referring to FIG. 2, a sectional view of an audio speaker including a voice coil having epoxy-bound winding layers is shown in accordance with an embodiment. The audio speaker 104 may include conventional components, including a frame 202 within which a magnetic structure is housed. The magnetic structure may include a magnet 204 supported by a yoke 206. The magnet 204 may be positioned between a top plate 208 and the yoke 206 such that a magnetic field is directed from the magnet 204 through the top plate 208 and across a magnetic gap 210 to the yoke 206. A diaphragm 212 may be supported relative to the frame 202 by a surround 214. More particularly, the surround 214 may suspend the diaphragm 212 along a central axis 216, and the flexibility of the surround 214 may allow the diaphragm 212 to move along the central axis 216 with pistonic motion relative to the frame 202. That is, a center of diaphragm 212 may have a maximum amplitude and may move axially along central axis 216. Such pistonic motion of the diaphragm 212 can generate sound.

Pistonic motion of the diaphragm 212 may result from an oscillatory force applied to the diaphragm 212 and/or the surround 214 by a voice coil 218. More particularly, the voice coil 218 may be suspended within the magnetic gap 210 such that an electrical current delivered through the voice coil 218 interacts with the magnetic field in the magnetic gap 210 to bias the voice coil 218 in a longitudinal direction, e.g., upward or downward in the direction of the central axis 216. This so-called "Lorentz force" applied to the voice coil 218 may be transmitted to the diaphragm 212 and/or the surround 214. For example, an upper end of the voice coil 218 may be attached, e.g., glued or otherwise connected, to the diaphragm 212 and/or the surround 214, and thus, a force applied to the voice coil 218 may cause a reactive movement of the diaphragm 212.

An amount of force transmitted to the diaphragm 212 by the voice coil 218 may be determined at least in part by a structure of the voice coil 218. In an embodiment, the voice coil 218 includes coil windings 220 centered within the magnetic gap 210, and an epoxy matrix binding the coil windings 220 together and/or connecting the coil windings 220 to the diaphragm 212. As described below, the epoxy matrix may provide sufficient strength to bind the coil windings 220 together and maintain their rigidity for efficient force transfer from the voice coil 218 to the diaphragm 212. The use of an epoxy as a structural adhesive may have certain benefits, including: structural stability, thermal performance, and lower cost as compared to other binders.

The coil windings 220 of the audio speaker 104 may have dimensions corresponding to a micro speaker form factor. For example, the coil windings 220 may include a wire coil having several wire turns around the central axis 216, and the wire turns may have respective turn diameters 222 measured perpendicular to the central axis 216. The turn diameters 222 may be less than 35 millimeters, which may be typical of a micro speaker. In a case of non-circular speaker shapes, such as rectangular designs commonly employed in space-constrained applications, the turn diameters 222 may be effective diameters, i.e., a dimension measured across the coil windings 220. For example, voice coil 218 having noncircular coil windings 220 may have rectangular coil windings 220, and the coil windings 220 may have an effective diameter measured as a width of the rectangular coil windings 220. Other dimensions of the coil windings 220 may also be typical of a micro speaker. Coil windings 220 may be attached to a bobbin 224, or voice-coil may be bobbin-less, as described below. For example, the wire of the coil windings 220 may have a wire diameter that is typical of micro speakers but not typical of larger loudspeakers that incorporate bobbins 224 in their voice coils 218. Accordingly, the audio speaker 104 may be a micro speaker.

Figure 3:
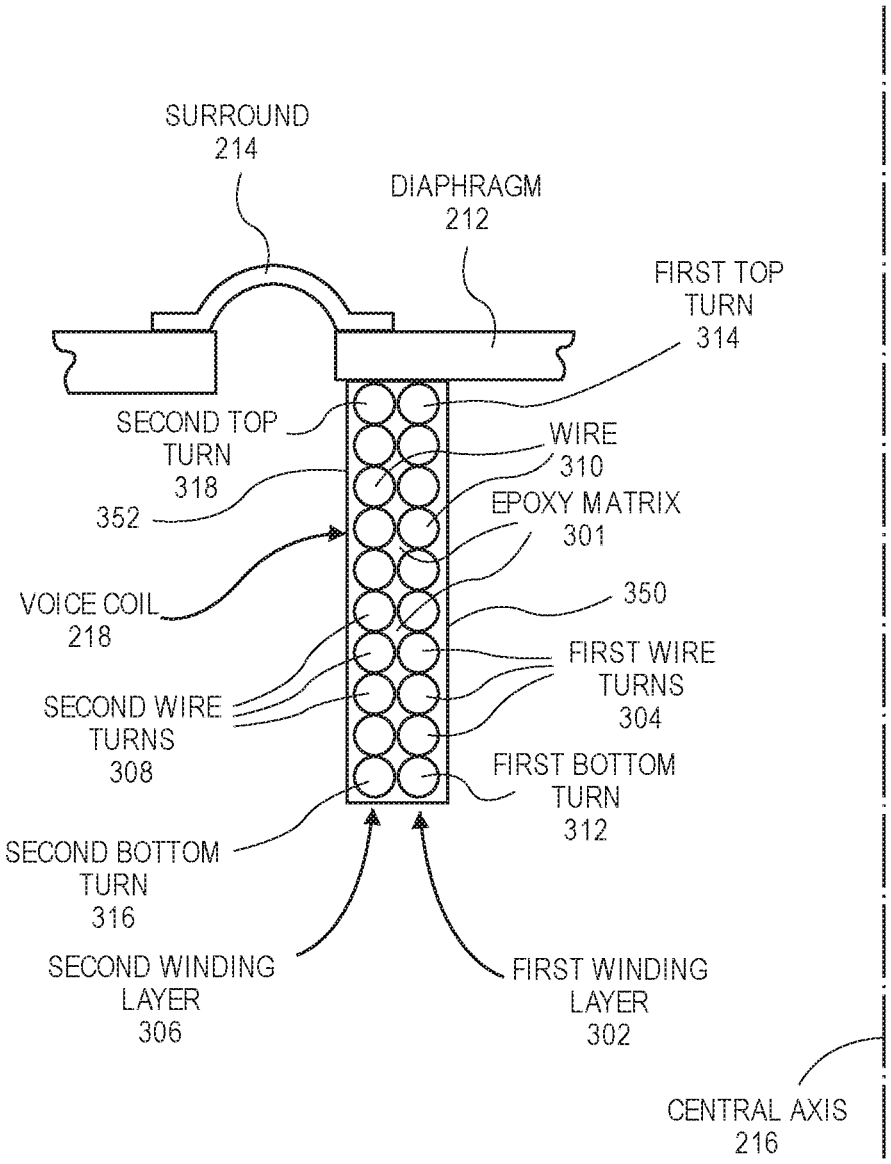
FIG. 3 is a sectional view of a voice coil having epoxy-bound winding layers in accordance with an embodiment.

Referring to FIG. 3, a sectional view of a voice coil having epoxy-bound winding layers is shown in accordance with an embodiment. The coil windings 220 of the voice coil 218 may include several winding layers. For example, the voice coil 218 may include a two-layer coil having two coil windings 220 in an epoxy matrix 301. A first winding layer 302 may include several first wire turns 304 around the central axis 216. The voice coil 218 may also include a second winding layer 306 having several second wire turns 308 around the central axis 216.

In an embodiment, the several winding layers may be coaxial. For example, second winding layer 306 may be coaxial with first winding layer 302 about the central axis 216. That is, first wire turns 304 and second wire turns 308 may have respective coil diameters around central axis 216, and the coil diameters may be concentrically disposed about central axis 216. Furthermore, the coaxial winding layers may be overlapping in the axial direction. That is, one or more first wire turns 304 may be disposed radially inward from one or more second wire turns 308. For example, second wire turns 308 may define a cylindrical envelope about central axis 216, and one or more first wire turns 304 may be disposed within the cylindrical envelope.

As described below, the voice coil 218 may include more than two winding layers. For example, the voice coil 218 may include three or more winding layers, e.g., four winding layers. Each winding layer may be radially offset from another winding layer. For example, the first winding layer 302 may be radially offset inward from the second winding layer 306, relative to the central axis 216. Again, at least a portion of the cylindrical form defined by first winding layer 302 may be concentrically disposed within the cylindrical form defined by second winding layer 306.

A same wire 310 may be used to form each winding layer of the voice coil 218. For example, a wire 310 may be coiled to form the first wire turns 304 stacked or disposed longitudinally along the central axis 216. That is, the wire turns of the first winding layer 302 may be longitudinally disposed along the central axis 216 between a first bottom turn 312 and a first top turn 314. Similarly, the wire turns of the second winding layer 306 may be longitudinally disposed along the central axis 216 between a second bottom turn 316 and a second top turn 318. The respective cylindrical forms of winding layers may be defined with reference to the top and bottom turns. For example, a top surface of each cylindrical form may be defined by a plane extending through the top turn and orthogonal to central axis 216. Similarly, a bottom surface of each cylindrical form may be defined by a plane extending through the bottom turn and orthogonal to central axis 216. The sidewalls of each cylindrical form may be defined by the winding itself, i.e., by a curved surface extending along the coiled wire turns between the top and bottom surfaces of the cylindrical form.

Longitudinally disposed wire turns may be coiled around central axis 216 such that the wire turns follow a helical path along central axis 216. The helical path may have a diameter and a pitch. In an embodiment, each turn of a winding layer has a same diameter such that the turns are stacked upon each other in the axial direction. The turns may have different diameters, however. For example, the turns may follow a spiral path to form a conical winding. The winding layers may have any number of wire turns. For example, the first winding layer 302 and/or the second winding layer 306 may have 5-30 wire turns between the respective bottom turns and the top turns. In an embodiment, at least two winding layers of the voice coil 218 have different numbers of wire turns.

In an embodiment, the epoxy matrix 301 of the voice coil 218 is at least partly between the first winding layer 302 and the second winding layer 306. For example, the epoxy matrix 301 may be radially between winding layers. That is, epoxy may fill an interstitial space between the first winding layer 302 and the second winding layer 306 in a radial direction emanating from the central axis 216. Accordingly, the epoxy matrix 301 may bond the first wire turns 304 to the second wire turns 308. As described above, the first wire turns 304 may be bound within the second wire turns 308, i.e., coaxial and concentric with second wire turns 308.

The epoxy matrix 301 may separate the first wire turns 304 from the second wire turns 308. For example, first wire turns 304 may have respective outer radial surfaces at a radial distance from central axis 216, and second wire turns 308 may have respective inner radial surfaces at a radial distance from central axis 216. The radial distances of the inner radial surfaces may be greater than the radial distances of adjacent outer radial surfaces such that a radial gap is defined between adjacent first and second wire turns 304, 308. The radial gap may be filled by epoxy matrix 301, and thus, epoxy matrix 301 may separate the turns radially.

The epoxy matrix 301 may encapsulate one or more of the wire turns of the voice coil 218. For example, the epoxy matrix 301 may have a cylindrical profile that includes an inner epoxy surface 350 and an outer epoxy surface 352, relative to the central axis 216, and the winding layers of the voice coil 218 may be potted within the epoxy matrix 301 between the inner and outer epoxy surfaces 350, 352. Thus, the epoxy matrix 301 may act as a structural binder to rigidify the voice coil 218.

The epoxy matrix 301 may connect the voice coil 218 to the diaphragm 212 and/or the surround 214. For example, the epoxy matrix 301 may bond the first top turn 314 or the second top turn 318 directly to a bottom surface of the diaphragm 212. Thus, the voice coil 218 may not include a bobbin 224, and instead, the epoxy matrix 301 may fulfill the functions of attaching the coil windings 220 to the diaphragm 212 and suspending the coil windings 220 within the magnetic gap 210.

Figure 4A:
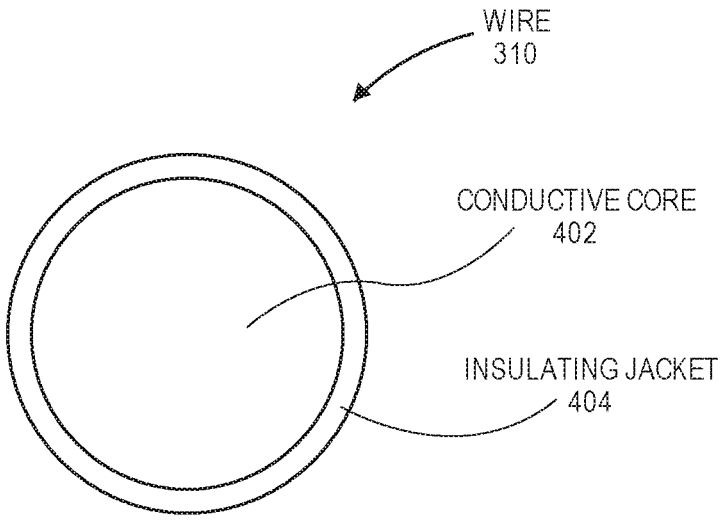
FIGS. 4A-4B are sectional views of a wire of a voice coil in accordance with an embodiment.

Referring to FIG. 4A, a sectional view of a wire of a voice coil is shown in accordance with an embodiment. The wire 310 that is wound into a coil (spiral of the wire turns) may be composed of several layers. For example, the wire 310 may include a conductive core 402, e.g., a copper wire, and an insulating jacket 404 around the conductive core 402. The insulating jacket 404 may, for example, be a polymeric coating surrounding the conductive core 402. In an embodiment, the insulating jacket 404 is an outermost layer of the wire 310. Thus, the epoxy matrix 301 may contact the insulating jacket 404 of the wire 310 of both the first wire turns 304 and the second wire turns 308.

Figure 4B:
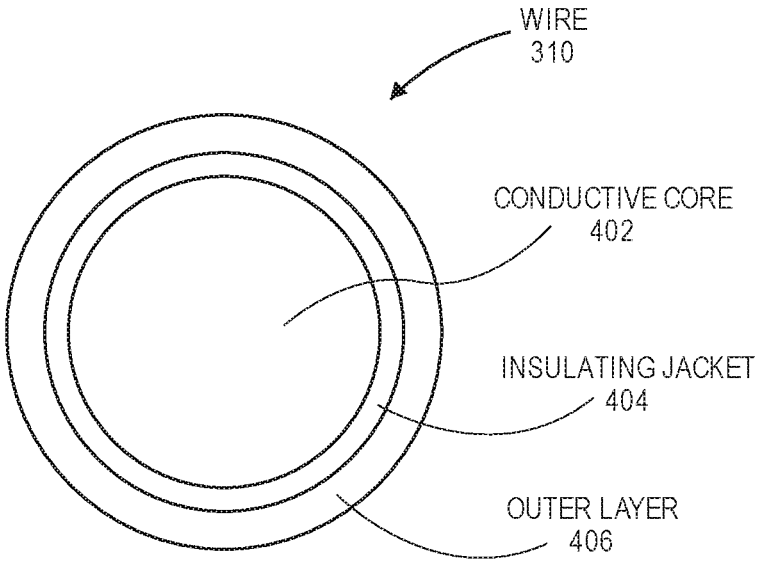

Referring to FIG. 4B, a sectional view of a wire of a voice coil is shown in accordance with an embodiment. The wire 310 of the wire turns of the voice coil 218 may include more than two layers. For example, the wire 310 may include the conductive core 402 surrounded by the insulating jacket 404, and an outer layer 406 may surround 214 the insulating jacket 404. In an embodiment, the outer layer 406 includes an adhesive layer. The adhesive layer may, for example, be an adhesive jacket configured to reflow when subjected to hot air. Thus, a hot air winding process may be used to direct heated air, e.g., air having a temperature of 300-500 degrees Fahrenheit, to cause wire turns of the first winding layer 302 or the second winding layer 306 to bond to each other. Accordingly, the outer layer 406 of the wire 310 may provide a supplemental binding for the winding layers, in addition to the structural support provided by the epoxy matrix 301.

Figure 5:
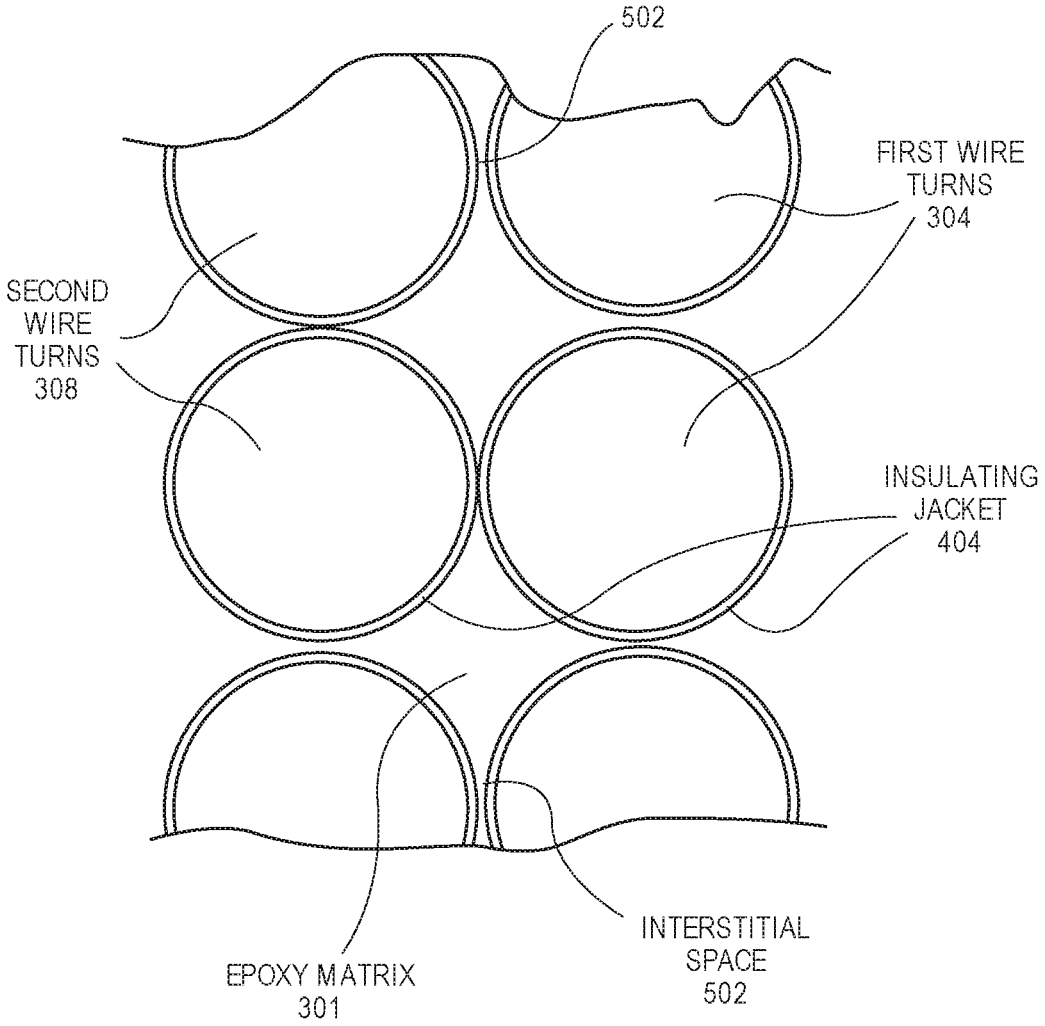
FIG. 5 is a sectional view of a voice coil having epoxy-bound winding layers in accordance with an embodiment.

Referring to FIG. 5, a sectional view of a voice coil having epoxy-bound winding layers is shown in accordance with an embodiment. As shown, at least one first wire turn 304 and one second wire turn 308 may be spaced apart from each other to form an interstitial space 502 less than a diameter of the wire 310 forming the turns. Thus, the epoxy matrix 301 may be directly between at least two wire turns within the interstitial space 502. That is, the epoxy matrix 301 may fill a gap between two wire turns, and the gap may be located along an axis drawn through the centers of the spaced apart wire turns. Furthermore, as shown in the middle pair of wire turns in FIG. 5, at least one first wire turn 304 and one second wire turn 308 may be in direct contact with each other. For example, an outermost layer, e.g., the insulating jacket 404, of the wire turns may be in contact. As described above, the outermost layer may also be an adhesive layer bonding the wire turns together. Thus, the epoxy matrix 301 may be between only a portion of the wire turns, i.e., the portions offset from the axis drawn through the centers of the abutting wire turns. Depending on the thickness of the outermost wire 310 adhesive bond layer, and the tension applied during the winding process, much if not all of the air spaces between the wires 310 may already be displaced as the bond layer flows within the spaces between the wires 310. In such case, the epoxy matrix 301 could still be applied on the outer surfaces and may provide additional strength to the wound coil by filling the remaining spaces on the exterior coil surfaces.

Figure 6:
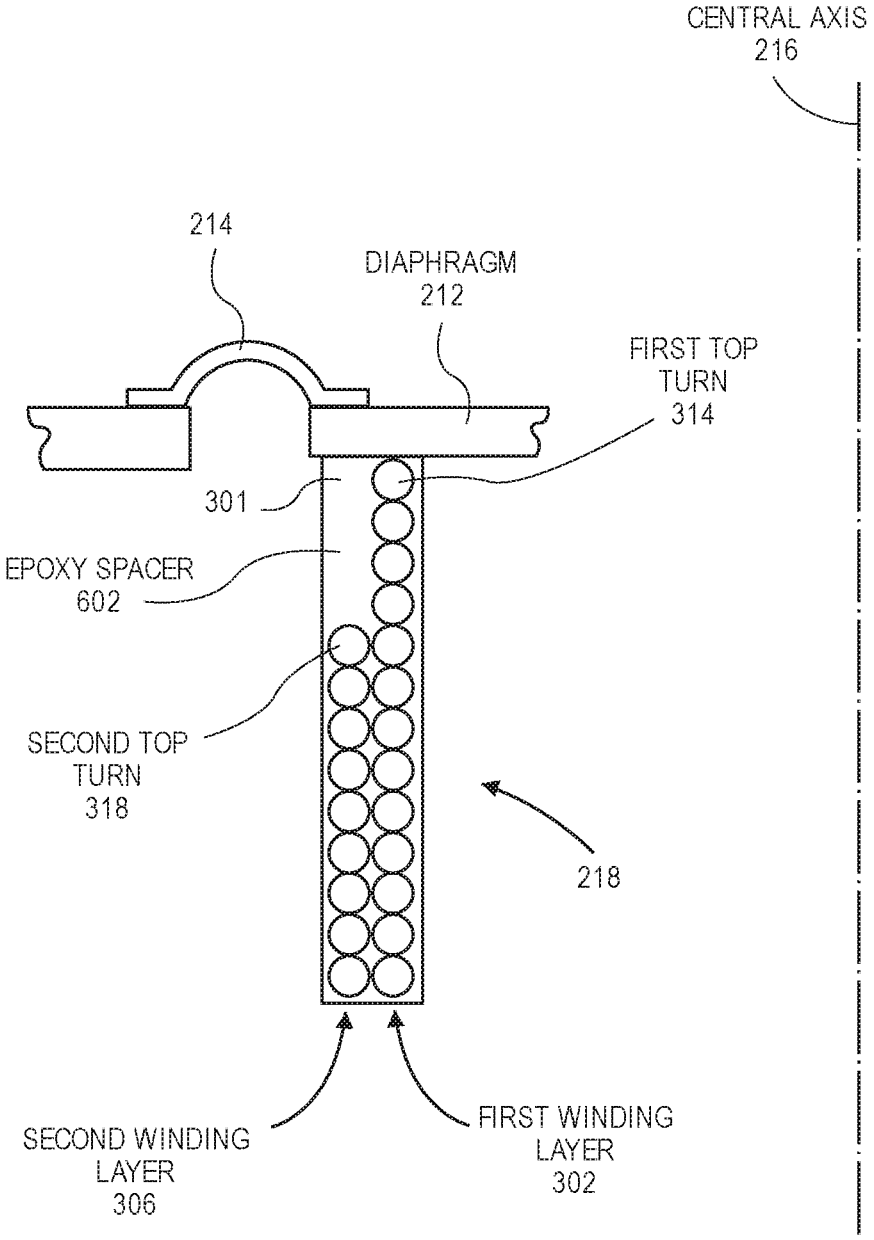
FIG. 6 is a sectional view of a two-layer voice coil having epoxy-bound winding layers and an epoxy spacer in accordance with an embodiment.

Referring to FIG. 6, a sectional view of a two-layer voice coil having epoxy-bound winding layers and an epoxy spacer is shown in accordance with an embodiment. The voice coil 218 may include a two-layer coil having several windings in the epoxy matrix 301, and at least one of the windings may be a partial winding. The epoxy matrix 301 of the voice coil 218 may include an epoxy spacer 602. The epoxy spacer 602 may be a portion of the epoxy matrix 301 that separates a top turn of a partial winding layer from the diaphragm 212 and/or the surround 214. More particularly, the epoxy spacer 602 may separate the topmost turn from a top surface of the epoxy matrix 301.

The voice coil 218 shown in FIG. 6 includes the first winding layer 302 having the first top turn 314 and the second winding layer 306 having the second top turn 318. The first top turn 314 may be longitudinally offset from the second top turn 318. That is, the first top turn 314 may be nearer to the diaphragm 212 in the longitudinal direction than the second top turn 318. Thus, the epoxy matrix 301, which forms a supportive structure around the voice coil windings 220, may include the epoxy spacer 602 longitudinally over the second top turn 318. That is, the epoxy spacer 602 may fill the gap between the second top turn 318 and the diaphragm 212 in the longitudinal direction. The gap may be radially offset from the first winding, and thus, the epoxy spacer 602 may be radially offset from the first top turn 314 and/or the first winding layer 302. That is, a portion of first winding layer 302 may be coaxial and concentric with epoxy spacer 602. It is noted that the structural configuration shown in FIG. 6 is provided by way of example, and in an embodiment, the winding layers may be reversed such that the second top turn 318 is nearer to the diaphragm 212 than the first top turn 314, and the epoxy spacer 602 is longitudinally over the first top turn 314, radially inward from the second top turn 318.

Figure 7A:
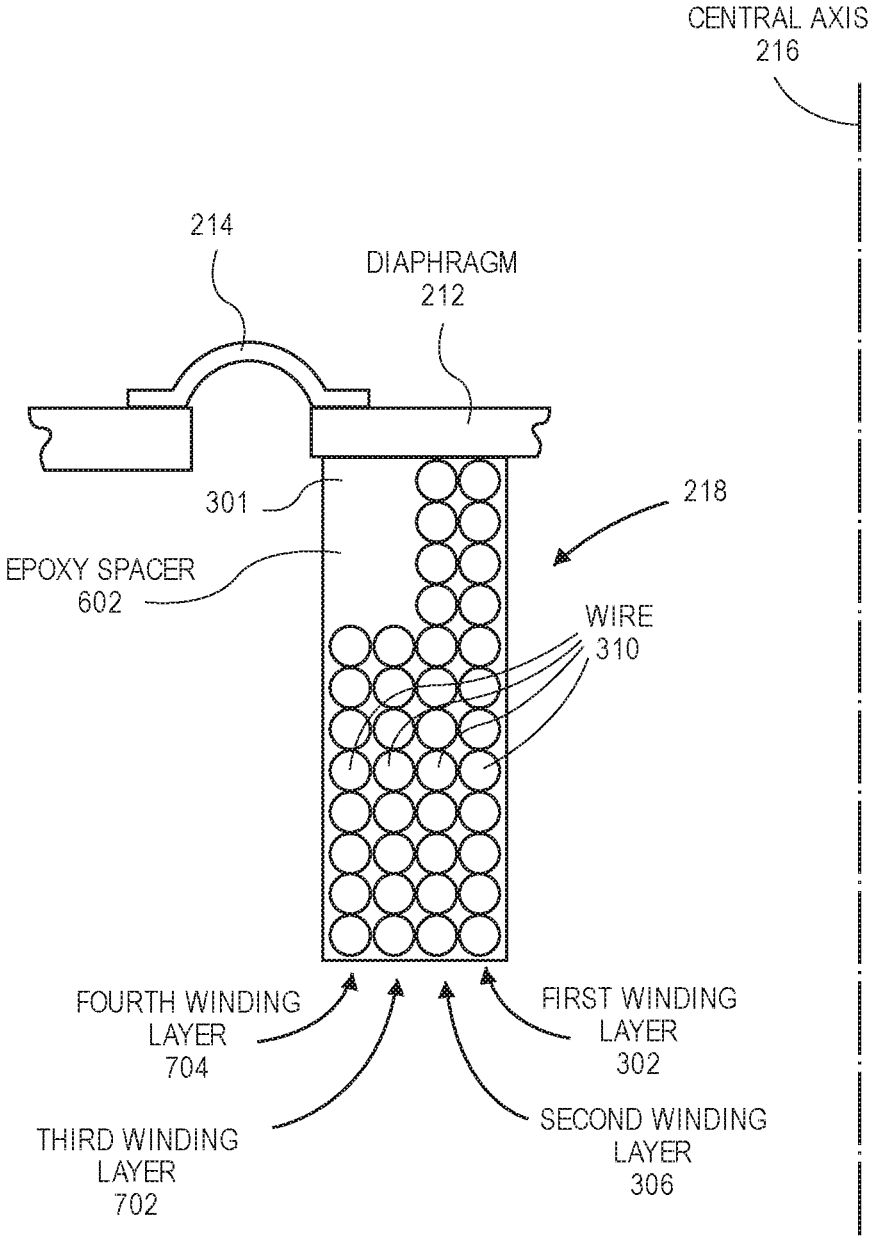
FIGS. 7A-7B are sectional views of a four-layer voice coil having epoxy-bound winding layers and a partial epoxy spacer in accordance with an embodiment.
Figure 7B:
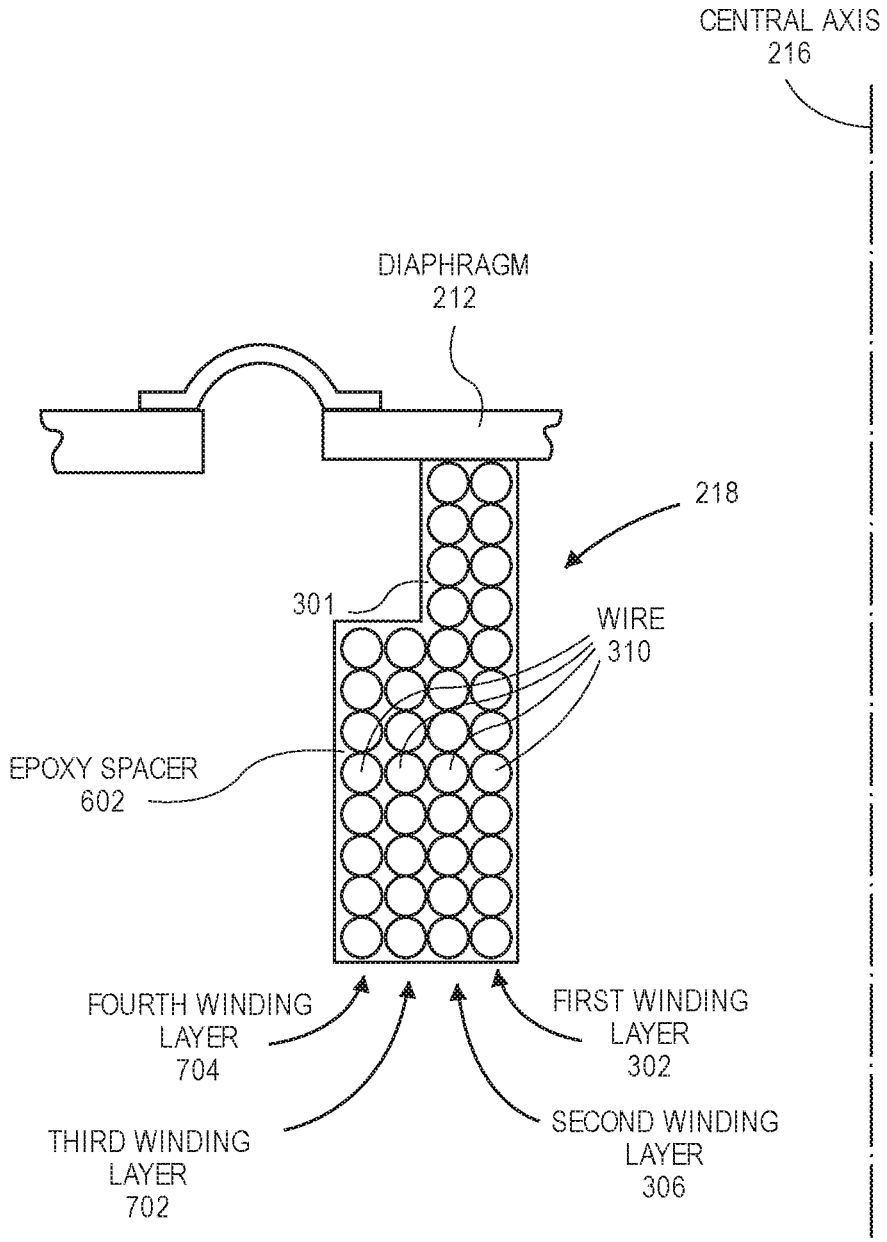

Referring to FIG. 7A, a sectional view of a four-layer voice coil having epoxy-bound winding layers and an epoxy spacer is shown in accordance with an embodiment. The voice coil 218 may include a four-layer coil having several windings in the epoxy matrix 301, and at least one of the windings may be a partial winding. In an embodiment, the first winding layer 302 and the second winding layer 306 are full windings, meaning that each of those windings are longitudinally disposed along the central axis 216 between respective bottom turns and the top turns, and the top turns are positioned above the magnetic gap 210. By contrast, the partial windings may not include wire turns, e.g., a top turn, above the magnetic gap 210, but rather, all turns of the partial windings may be within the magnetic gap 210. The coil could also be made with only a single full layer, with the remaining three layers being partial layers. As shown in FIG. 7B, the windings may be suspended from the diaphragm by a partial thickness epoxy matrix over only a portion of the winding layers. For example, a four-layer voice coil 218 may be suspended by an epoxy matrix 301 having a thickness of only two layers of the voice coil 218. Windings may be (as shown), or may not be, embedded within the epoxy matrix 301 above the four-layer voice coil 218. The epoxy matrix 301 may bond the top turns directly to the diaphragm 212. That is, the epoxy matrix 301 may have a thickness between the diaphragm 212 and the top turn less than three times the diameter of the wire 310 forming the turns. In an embodiment, a third winding layer 702 and a fourth winding layer 704 are partial windings. More particularly, the epoxy spacer 602 portion of the epoxy matrix 301 may be vertically above the partial windings such that respective top turns of the windings are separated from the diaphragm 212 (FIG. 7A). Alternatively, an air gap may be above the partial winding, between the partial winding and diaphragm 212, and radially offset from the full windings (FIG. 7B).

Figure 8:
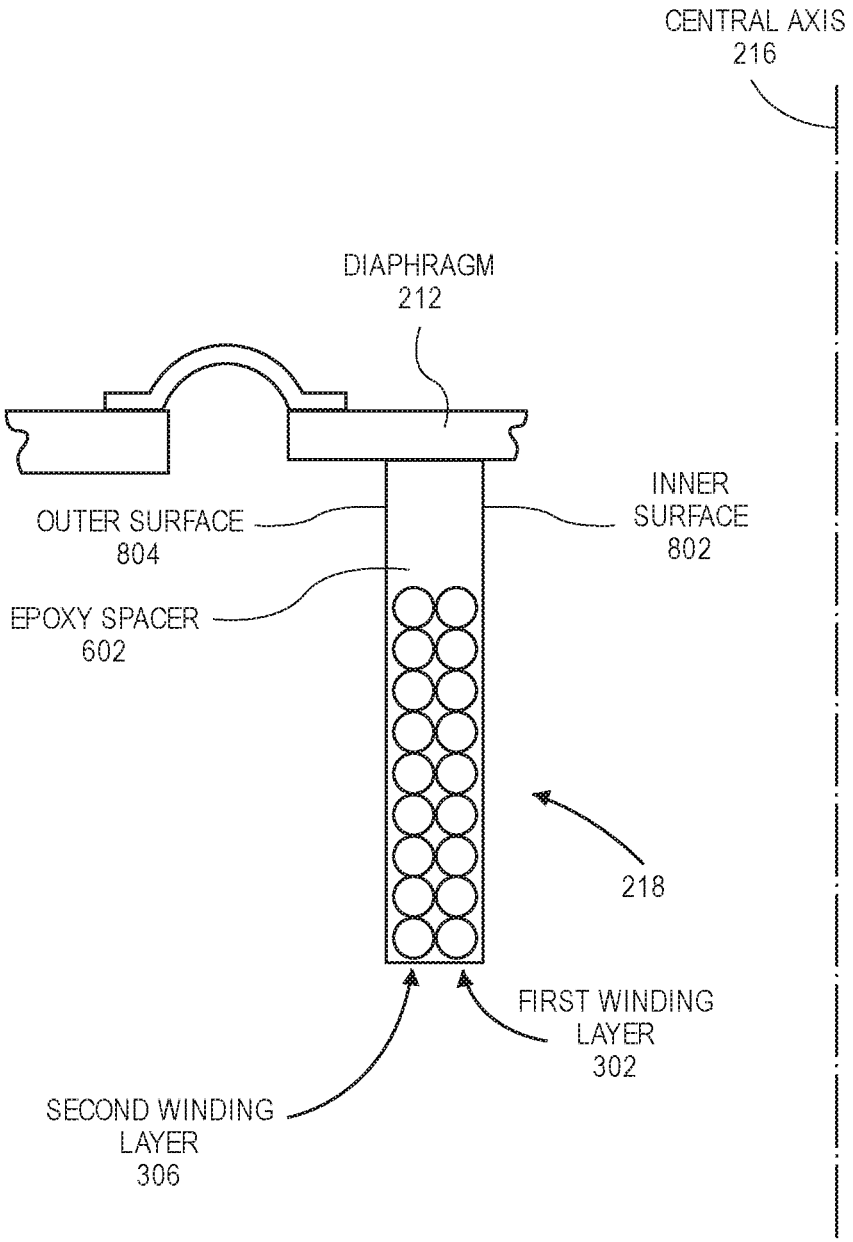
FIG. 8 is a sectional view of a voice coil having epoxy-bound partial winding layers and an epoxy spacer in accordance with an embodiment.

Referring to FIG. 8, a sectional view of a voice coil having epoxy-bound partial winding layers and an epoxy spacer is shown in accordance with an embodiment. The voice coil 218 may include several coil windings 220, e.g., a two-layer coil, and every winding may be a partial winding. More particularly, the epoxy spacer 602 may form an upper portion of the voice coil 218 that spans a width of the voice coil wall between an inner surface 802 and an outer surface 804 of the voice coil 218, e.g., between inner epoxy surface 350 and outer epoxy surface 352. The lower portion of the voice coil 218 may include the coil windings 220. For example, the first winding layer 302 and the second winding layer 306 may be longitudinally disposed between respective bottom turns and top turns, and the respective top turns may be separated from the diaphragm 212 by the epoxy spacer 602. Thus, the partial windings of the voice coil 218 may be positioned within the magnetic gap 210, and the epoxy spacer 602 may be positioned in an area above the magnetic gap 210 between the magnetic gap 210 and the diaphragm 212. One benefit of using the epoxy spacer 602 as shown in FIG. 8 is the mass savings which would result from eliminating wire 310 in the upper portion of the coil. More particularly, the wire 310 may have a specific gravity from 3.0 to 9.0, depending on a wire alloy used to form wire 310, and the epoxy may have a specific gravity close to 1.0. Accordingly, replacing the wire 310 with the epoxy matrix 301 reduces the overall mass and weight of the voice coil structure.

The epoxy spacer 602 portion of the epoxy matrix 301 may have various dimensions. For example, the epoxy spacer 602 may have a height that creates a separation between a top turn of a partial winding and the diaphragm 212, and the separation may include a distance of at least three times a diameter of the wire 310 in the coil windings 220. More particularly, however, the epoxy spacer 602 may have a predetermined height such that the partial windings do not include wire turns at a location of the voice coil 218 that does not pass into the magnetic gap 210 during operation of the audio speaker 104. Thus, as the voice coil 218 oscillates up and down during speaker operation, the epoxy spacer 602 may not enter the magnetic gap 210. Accordingly, the epoxy spacer 602 may be located in the area above the magnetic gap 210 to reduce and/or eliminate wire 310 mass in that area. Another benefit of the epoxy matrix 301 construction is that the lead wires 310 (the start and end of the coil windings 220) may be routed through the epoxy and positioned at any desirable location which may aid in assembly.

As described above, a width, i.e., a radial thickness, of the epoxy spacer portion of the epoxy matrix 301 may vary depending on the voice coil design. For example, the epoxy spacer 602 may occupy only a portion of a width between an inner surface 802 and outer surface 804 of the voice coil 218 (FIGS. 6-7), or the epoxy spacer 602 may occupy the entire width of the voice coil wall (FIG. 8). The width of the epoxy spacer 602 may be determined based on an amount of wire 310 mass that is desirable within the area above the magnetic gap 210. More particularly, although it may be beneficial to eliminate mass from the area above the magnetic gap 210, some wire mass within the area may be desirable to reduce the resonance of the audio speaker 104.

The material of the epoxy matrix 301 may be varied to obtain a desired structural robustness and mass of the voice coil 218. For example, an epoxy used to bind the windings together may be different from an epoxy that forms the epoxy spacer 602 to fill the gap above partial windings. More particularly, the epoxy matrix 301 may be formed from several epoxy resins having different densities and/or structural characteristics, and the epoxy resins may be cured to form different portions of the epoxy matrix 301 using different manufacturing operations. Accordingly, the epoxy used to bind the windings together within the magnetic gap 210 may have a different, e.g., a higher, stiffness and/or density than the epoxy used to form the epoxy spacer 602 disposed above the wire turns. Adjusting the stiffness/density of the portion above the windings may be desirable, for example, as a way to tune the mechanical resonance of the coil mass with the diaphragm 212 to purposely create or compensate for a resonance elsewhere in the system.

Figure 9:
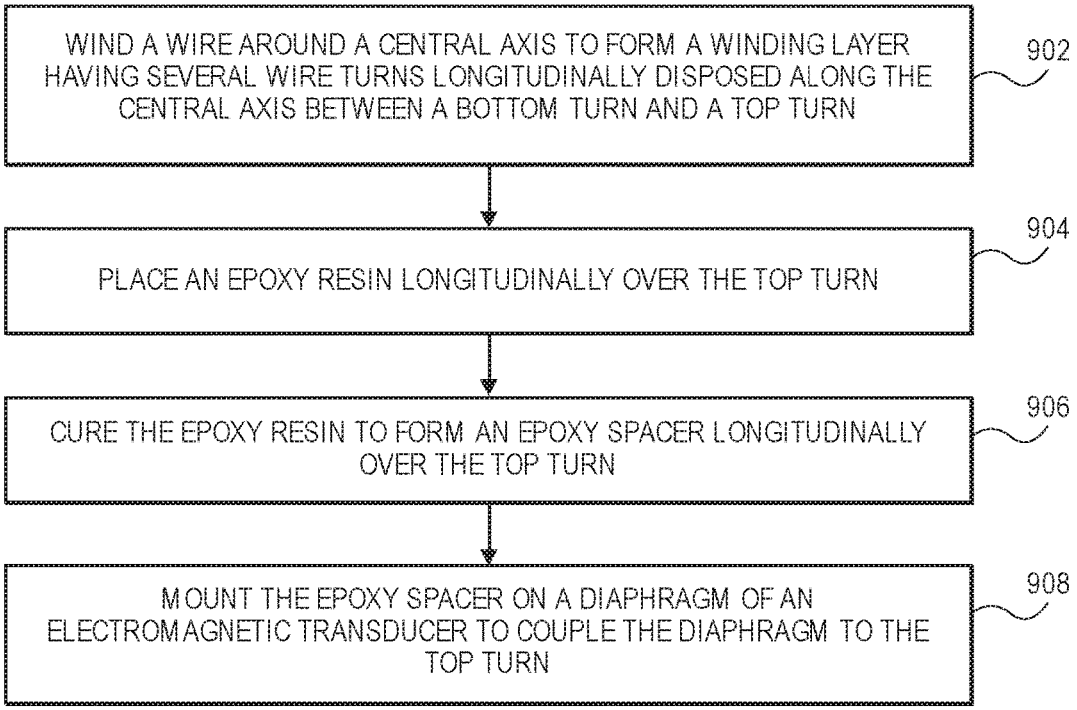
FIG. 9 is a flowchart of a method of manufacturing an audio speaker including a voice coil having epoxy-bound winding layers in accordance with an embodiment.

Referring to FIG. 9, a flowchart of a method of manufacturing an audio speaker including a voice coil having epoxy-bound winding layers is shown in accordance with an embodiment. The epoxy matrix 301 may be formed using known processing techniques. For example, the epoxy may be pre-coated on the wire 310 of the voice coil 218 prior to winding the wire 310 and the epoxy may be cured, e.g., using a hot air process, to bind the coil windings 220 in the epoxy matrix 301. The epoxy may be applied to the wire 310 as it is being wound into a coil, e.g., using a wet process (also known as a solvent winding), and the epoxy may be cured to bind the coil windings 220 in the epoxy matrix 301. The epoxy may be applied to a wound coil after the coil windings 220 are complete, e.g., by dipping the coil windings 220 into a bath of epoxy resin and removing the coated coil windings 220 to cure the epoxy and form the epoxy matrix 301. Thus, the method described below with respect to FIG. 9 is provided by way of example, and not limitation.

At operation 902, a wire 310 may be wound around a central axis 216 to form a winding layer. The winding layer may include several wire turns longitudinally disposed along the central axis 216 between a bottom turn and a top turn. As described above, the wire 310 may be continuously wound into several winding layers, e.g., a first winding layer 302 and a second winding layer 306. For example, the wire 310 may be wound in the first winding layer 302 beginning at the first bottom turn 312 and spiraling upward toward the first top turn 314, and the wire 310 may then be removed radially outward and wound in the second winding layer 306 beginning at the second top turn 318 adjacent to the first top turn 314 and spiraling downward around the first winding layer 302 toward the second bottom turn 316 adjacent to the first bottom turn 312.

At either operations 902 or operation 904, an epoxy resin may be placed within the interstices between the wire turns and longitudinally over the respective top turns of the winding layers. This operation may be accomplished in numerous manners. For example, when the first winding layer 302 is a full winding layer and the second winding layer 306 is a partial winding layer, the epoxy resin may be loaded between the interstices and radially outward from the first winding layer 302 to fill the space above the second winding layer 306 (between second winding layer 306 and diaphragm 212).

In an embodiment, an inner sleeve may be located within the first winding layer 302 and an outer sleeve may be located around an outside of the second winding layer 306 to form a gap between the sleeves. For example, winding the wire 310 around the central axis 216 may include winding the wire 310 around an inner sleeve, e.g., a cylindrical or rectangular polyimide or polytetrafluoroethylene sleeve. The inner sleeve may be coaxially aligned with the central axis 216. An outer sleeve may be slipped around the wound coil, and thus, the outer sleeve may also be coaxially aligned with the central axis 216. In an embodiment, a space between the sleeves includes a gap radially offset from the sleeve and longitudinally between a diaphragm 212 of an audio speaker 104 and the top turn of one or more of the coil windings 220 in the voice coil 218. The gap between the sleeves may be filled with the epoxy resin. Vacuum may be applied to assist permeation of the epoxy resin into the interstitial spaces 502 between wire turns, and to reduce the likelihood of air bubbles being trapped within the epoxy matrix 301 of the voice coil 218. That is, epoxy matrix 301 may have no air voids, i.e., epoxy matrix 301 may be solid.

At operation 906, the epoxy resin may be cured to form the epoxy matrix 301 having the epoxy spacer 602 longitudinally over the top turn of the partial winding(s). In an embodiment, the epoxy is heat-cured. For example, hot air may be convectively applied to the epoxy resin to cure the epoxy resin into an epoxy. In an embodiment, an electrical current may be passed through the wire 310 of the voice coil 218 to resistively heat the wire 310 and transfer heat to the epoxy resin. Thus, by delivering the electrical current through the wire 310, the epoxy resin may cure into a hardened state. Other epoxy curing techniques may be used, such as directing ultraviolet radiation to the epoxy resin to cure the epoxy resin into an epoxy. Adding UV curing initiators is known to one skilled in the art of formulating both acrylic and epoxy adhesives.

At operation 908, the epoxy matrix 301 may be mounted on a diaphragm 212 of an electromagnetic transducer. More particularly, the epoxy matrix 301 may be attached to the diaphragm 212 of the audio speaker 104 to connect the diaphragm 212 to the top turns of the coil windings 220. An epoxy spacer 602 of the epoxy matrix 301 may connect the diaphragm 212 to top turns of partial windings. For example, curing the epoxy resin to form the epoxy matrix 301 may be performed while the epoxy resin is in contact with the diaphragm 212, and thus, the curing may bond the epoxy matrix 301 to the diaphragm 212. In turn, the epoxy matrix 301 may bond the diaphragm 212 to the top turn of the voice coil 218. In an embodiment, after curing the epoxy resin to form the epoxy matrix 301, the sleeve(s) may be removed from the voice coil 218. For example, the sleeves may be slid away from the winding layers. The cured voice coil 218 may be attached to the diaphragm 212 in a secondary operation, e.g., by applying an adhesive between a top surface of the voice coil 218 and a bottom surface of the diaphragm 212 to adhesively bond the components together.

Figure 10:
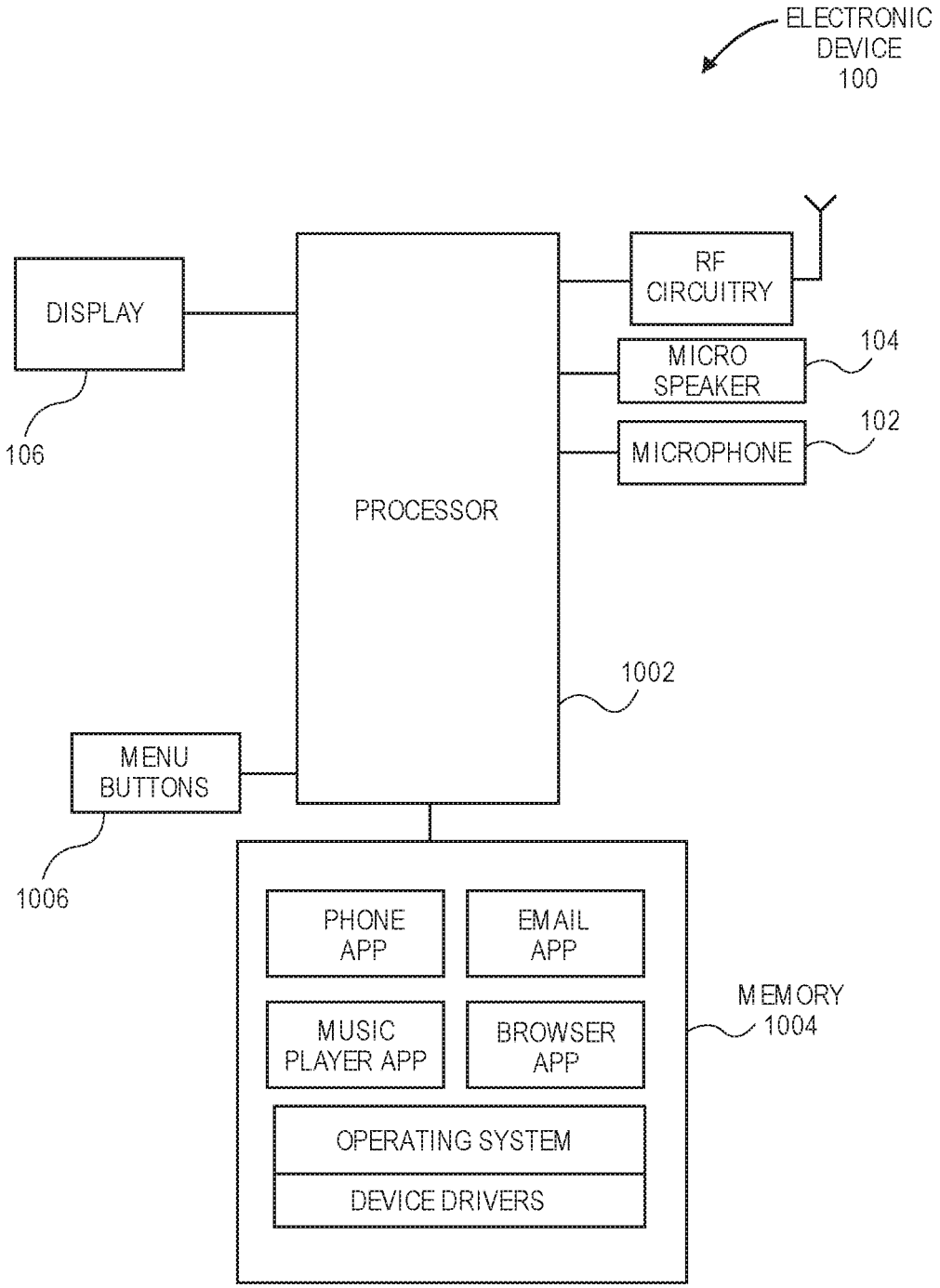
FIG. 10 is a schematic view of an electronic device having an audio speaker in accordance with an embodiment.

Referring to FIG. 10, a schematic view of an electronic device having an audio speaker is shown in accordance with an embodiment. As described above, the electronic device 100 may be one of several types of portable or stationary devices or apparatuses with circuitry suited to specific functionality. Thus, the diagrammed circuitry is provided by way of example and not limitation. The electronic device 100 may include one or more processors 1002 to execute instructions to carry out the different functions and capabilities described above. Instructions executed by the one or more processors 1002 of electronic device 100 may be retrieved from local memory 1004, and may be in the form of an operating system program having device drivers, as well as one or more application programs that run on top of the operating system, to perform the different functions introduced above, e.g., phone or telephony and/or music play back. Processor 1002 may receive input signals from various input devices or elements, such as menu buttons 1006 selectable through a graphical user interface. In response to such input signals, processor 1002 may execute instructions to directly or indirectly implement control loops and provide drive signals to the voice coil 218 of audio speaker 104 to drive the diaphragm motion along central axis 216 to generate sound.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A voice coil, comprising:

a first winding layer including a plurality of first wire turns around a central axis, wherein the first wire turns are longitudinally disposed along the central axis between a first bottom turn and a first top turn;

a second winding layer including a plurality of second wire turns coaxial with the first winding layer around the central axis, wherein the second wire turns are longitudinally disposed along the central axis between a second bottom turn and a second top turn, and wherein the first winding layer is radially offset from the second winding layer; and an epoxy matrix having a profile that includes an outer epoxy surface and an inner epoxy surface extending in a longitudinal direction relative to the central axis, wherein the epoxy matrix encapsulates the first winding layer and the second winding layer between the outer epoxy surface and the inner epoxy surface, and wherein the epoxy matrix bonds the plurality of first wire turns to the plurality of second wire turns to rigidify the voice coil, wherein the epoxy matrix includes an epoxy spacer longitudinally over one or more of the first top turn or the second top turn, and wherein the epoxy spacer has a height at least three times a diameter of a wire forming the wire turns.

2. The voice coil of claim 1, wherein the first top turn is longitudinally offset from the second top turn.

3. The voice coil of claim 2, wherein the epoxy spacer is radially offset from the first winding layer, and wherein the epoxy spacer is longitudinally over the second top turn.

4. The voice coil of claim 1, wherein the wire turns include the wire having a conductive core surrounded by an insulating jacket, and wherein the epoxy matrix contacts the insulating jacket of the wire of the first wire turns and the second wire turns.

5. The voice coil of claim 4, wherein the wire turns include respective turn diameters about the central axis, and wherein the turn diameters are less than 25 millimeters.

6. The voice coil of claim 1 further comprising a diaphragm configured to move along the central axis, wherein the voice coil is coupled to the diaphragm.

7. The voice coil of claim 6, wherein the epoxy matrix bonds the first top turn to the diaphragm.

8. The voice coil of claim 1, wherein the epoxy matrix encapsulates the first winding layer and the second winding layer by filling spaces between the first winding layer and the second winding layer.

9. An electromagnetic transducer for sound generation, comprising:

a diaphragm configured to move along a central axis; and a voice coil coupled to the diaphragm, wherein the voice coil includes:

a first winding layer including a plurality of first wire turns around the central axis, wherein the first wire turns are longitudinally disposed along the central axis between a first bottom turn and a first top turn, a second winding layer including a plurality of second wire turns coaxial with the first winding layer around the central axis, wherein the first winding layer is radially offset from the second winding layer, wherein the second wire turns are longitudinally disposed along the central axis between a second bottom turn and a second top turn, and an epoxy matrix having a profile that includes an outer epoxy surface and an inner epoxy surface extending in a longitudinal direction relative to the central axis, wherein the epoxy matrix encapsulates the first winding layer and the second winding layer between the outer epoxy surface and the inner epoxy surface, wherein the epoxy matrix bonds the plurality of first wire turns to the plurality of second wire turns to rigidify the voice coil, wherein the epoxy matrix includes an epoxy spacer longitudinally over one or more of the first top turn or the second top turn, and wherein the epoxy spacer has a height at least three times a diameter of a wire forming the wire turns.

10. The electromagnetic transducer of claim 9, wherein the epoxy matrix bonds the first top turn to the diaphragm.

11. The electromagnetic transducer of claim 9, wherein the first top turn is longitudinally offset from the second top turn.

12. The electromagnetic transducer of claim 11, wherein the epoxy spacer is radially offset from the first winding layer, and wherein the epoxy spacer is longitudinally over the second top turn.

13. The electromagnetic transducer of claim 9, wherein the wire turns include the wire having a conductive core surrounded by an insulating jacket, and wherein the epoxy matrix contacts the insulating jacket of the wire of the first wire turns and the second wire turns.

14. A method, comprising:

winding a wire around a central axis to form a first winding layer and a second winding layer, wherein the first winding layer includes a plurality of first wire turns longitudinally disposed along the central axis between a first bottom turn and a first top turn, wherein the plurality of first wire turns are around the central axis, wherein the second winding layer includes a plurality of second wire turns coaxial with the first winding layer around the central axis, wherein the second wire turns are longitudinally disposed along the central axis between a second bottom turn and a second top turn, and wherein the first winding layer is radially offset from the second winding layer;

placing an epoxy resin longitudinally over the first top turn and between the first winding layer and the second winding layer;

curing the epoxy resin to form an epoxy matrix having a profile that includes an outer epoxy surface and an inner epoxy surface extending in a longitudinal direction relative to the central axis, wherein the epoxy matrix encapsulates the first winding layer and the second winding layer between the outer epoxy surface and the inner epoxy surface, wherein the epoxy matrix bonds the plurality of first wire turns to the plurality of second wire turns, wherein the epoxy matrix includes an epoxy spacer longitudinally over one or more of the first top turn or the second top turn, and wherein the epoxy spacer has a height at least three times a diameter of the wire forming the wire turns; and mounting the epoxy matrix on a diaphragm of an electromagnetic transducer, wherein the epoxy matrix couples the diaphragm to the first top turn.

15. The method of claim 14, wherein winding the wire includes winding the wire around a sleeve coaxially aligned with the central axis.

16. The method of claim 15 further comprising removing the sleeve from the winding layer.

17. The method of claim 16, wherein placing the epoxy resin includes filling a gap with the epoxy resin, wherein the gap is radially offset from the sleeve, and wherein the gap is longitudinally between the diaphragm and the first top turn.

18. The method of claim 14, wherein the epoxy spacer couples the diaphragm to the first top turn.

19. The method of claim 14, wherein curing the epoxy resin includes delivering an electrical current through the wire to heat-cure the epoxy resin.

* * * * *